US007776432B2

(12) United States Patent
Serwin et al.

(10) Patent No.: US 7,776,432 B2
(45) Date of Patent: Aug. 17, 2010

(54) SANDWICH PLATE-SHAPED CONSTRUCTION

(75) Inventors: Bo Serwin, Hoejbjerg (DK); Peter Buitelaar, El Kedichen (NL)

(73) Assignee: Serwin Holdings ApS, Hoejbjerg (DK)

( * ) Notice: Subject to any disclaimer, the term of this patent is extended or adjusted under 35 U.S.C. 154(b) by 994 days.

(21) Appl. No.: 10/553,444

(22) PCT Filed: Mar. 16, 2004

(86) PCT No.: PCT/DK2004/000170

§ 371 (c)(1), (2), (4) Date: Jul. 31, 2006

(87) PCT Pub. No.: WO2004/090252

PCT Pub. Date: Oct. 21, 2004

(65) Prior Publication Data

US 2007/0172641 A1 Jul. 26, 2007

(30) Foreign Application Priority Data

Apr. 14, 2003 (DK) ..... 2003 00584

(51) Int. Cl.

| | |
|---|---|
| ***B32B 27/32*** | (2006.01) |
| ***B32B 7/08*** | (2006.01) |
| ***B32B 15/04*** | (2006.01) |
| ***B32B 5/16*** | (2006.01) |
| ***B32B 18/00*** | (2006.01) |
| ***B32B 27/38*** | (2006.01) |

(52) U.S. Cl. ..... 428/323; 428/220; 428/223; 428/294.7; 428/297.4; 428/324; 428/325; 428/331; 428/332; 428/413; 428/418; 428/457; 428/489; 428/688; 428/539.5; 428/545; 428/703

(58) Field of Classification Search ..... None
See application file for complete search history.

(56) References Cited

U.S. PATENT DOCUMENTS

| | | | | |
|---|---|---|---|---|
| 3,774,359 | A * | 11/1973 | Kahn | 52/125.4 |
| 4,513,040 | A | 4/1985 | Lankard | |
| 4,979,992 | A | 12/1990 | Bache | |

FOREIGN PATENT DOCUMENTS

| | | | |
|---|---|---|---|
| CH | 646 930 | A5 | 12/1984 |
| DE | 24 05 155 | | 8/1975 |
| FR | 2 817 576 | A1 | 6/2002 |
| GB | 1 588 899 | | 4/1981 |
| JP | 6-167094 | | 6/1994 |
| WO | WO 97/33054 | A1 | 9/1997 |

* cited by examiner

*Primary Examiner*—Sheeba Ahmed
(74) *Attorney, Agent, or Firm*—David S. Safran; Roberts Mlotkowski Safran & Cole, P.C.

(57) ABSTRACT

Sandwich plate-like construction and method for making such a construction, wherein the construction comprises a steel plate, a contact layer and an inorganic layer, said inorganic layer at least comprises ultra fine particles and a binder. This type of construction is especially suitable as bridge decks, on oil platforms, ship decks, windmill foundations or towers, outdoor furniture, balconies and other tough and exposed applications.

12 Claims, 5 Drawing Sheets

SANDWICH PLATE-SHAPED CONSTRUCTION

The invention relates to a composite sandwich plate-like construction, use of such a construction as well as a method for making such a construction.

BACKGROUND OF THE INVENTION

In the art it is known to use sandwich-like constructions comprising a steel plate and a concrete layer. Reference is in this connection made to document DE 1800858, which illustrates a construction where a concrete material is cast on a steel plate member. In this configuration it is not possible to transfer shear forces from the concrete to the steel since the bond between steel and concrete is relatively poor in comparison to the requirements in a situation where it is desirable to transfer shear forces from the concrete to the steel plate member.

According to British Standard BS8110, part 1, section 5.4, it is a requirement that when casting concrete on a steel plate, as for example illustrated above with reference to DE 1800858, studs or anchors shall be arranged projecting from the steel into the concrete mass in order to transfer shear forces and thereby activate the steel member. The detailed arrangement, i.e. the size and number of studs/anchors, depends on the actual construction.

The advantages of constructions like the ones known in the art and as claimed by the present invention is that they utilise the good tension probabilities of the steel in combination with the compression capability of the concrete layer. The main problem for the prior art constructions is the transferral of forces from the composite layer, which in the art as mentioned above is a concrete layer to the tension layer in the shape of a steel plate.

According to common practise this is usually done by welding studs onto the side of the steel plate which is to come into contact with the composite layer such that these studs will be embedded in the composite material, preferably the concrete, such that the transferral of forces, especially shear forces which will arise when the construction is exposed to a bending moment, will be transferred to the steel plate via the welded studs.

A number of disadvantages are connected with this. First of all, it is a labour intensive process to weld a sufficient number of studs in order to be able to transfer sufficient force from the concrete layer to the steel plate or vice versa. As the cost of labour is increasing, these types of constructions become increasingly expensive and are un-competitive. Furthermore, in the places where the studs are welded on, the steel plate will, due to the welding process, have different properties than normal steel plates. One of the side effects of the welding process can be that the steel plate is more prone to corrosion in these areas such that especially careful corrosion protection is needed.

An additional problem arises due to the shrinkage of the composite material, for example concrete, during the hardening process. As the concrete shrinks, cracks will appear in the concrete surface. When they appear in such a degree that the concrete layer is not entirely homogenous, the studs will act as crack inducers in the concrete layer. Hereby water, chlorides $CO_2$ and other corrosive elements will gain access to the core of the construction and may cause accelerated corrosion of the construction. It is, therefore, often necessary in order to provide a longer life expectancy for this type of constructions to apply a coating on top of the concrete layer in order to hamper the ingression of chlorides, water and the like.

In order to minimize and distribute the crack formation, the concrete layers in this type of constructions are sometimes reinforced such that a crack distribution is achieved, whereby a smaller crack width, but more cracks, will be generated.

These sandwich plate-like constructions are often used in harsh environments where they may be exposed to dynamic forces which can exaggerate the crack formation and thereby lower the strength of the sandwich construction as well as the expected life span of such a construction. These types of constructions are often found on bridges, ship decks, oil platforms or other similar constructions.

OBJECT OF THE INVENTION

Consequently, it is the object of the invention to provide a new and inventive composite sandwich plate-like construction which alleviates at least some of the above mentioned disadvantages of the prior art constructions.

This is achieved by a composite sandwich plate-like construction comprising a tension plate, a contact layer and a compression layer, said compression layer being an inorganic layer, said inorganic layer at least comprising ultra fine particles and a binder.

By having the contact layer introduced between the steel plate and the inorganic layer and furthermore that the inorganic layer comprises a binder containing ultra fine particles, a number of advantages are achieved.

Firstly, in stead of transferring shear forces by means of studs, the entire surface due to the characteristics of the contact layer will be able to transfer shear forces. Hereby a much stronger construction is achieved as the load can be distributed to the entire surface and not only transferred in a number of points corresponding to the number of studs. Furthermore, the ultra fine particles in the inorganic layer will create a very dense layer which will be substantially tighter against the ingression of chlorides, $CO_2$ and water. These factors altogether create a longer lasting and stronger construction.

FURTHER ADVANTAGEOUS EMBODIMENTS

In a further advantageous embodiment the inorganic layer encapsulates a reinforcement, said reinforcement being steel bars, steel wire, carbon wire or rods and/or carbon-, glass-, plastic- and/or steel fibres. The combination of being able to transfer forces, predominantly shear forces, onto the entire contact surface in combination with the reinforcement provides a number of advantages. The traditional crack distribution reinforcement effect is also achieved, especially when fibres are mixed into the inorganic layer. Furthermore, by having the traditional reinforcement working together with the fibre reinforcement, the tension zone is not limited to the steel plate alone, but will be transferred via the contact layer into the reinforcement embedded in the concrete such that an altogether much stronger construction is achieved.

In a still further advantageous embodiment of the invention the reinforcement bars or rods constitute 3% to 60% by weight of inorganic layer, more preferred 5% to 35% by weight of the inorganic layer and most preferred 6% to 20% by weight of the inorganic layer.

In the manuals for designing traditional reinforced concrete the international standards usually prescribe a reinforcement percentage between 0.2 to 0.6% of the cross-section corresponding to up to 2% by weight of the cross-section.

The reasons for advising 0.2 to 0.6% reinforcement for plates is that, due to the concrete's characteristics, it will not be possible to utilise more reinforcement in that the concrete will not be able to transfer forces to the reinforcement above the level corresponding to 0.6% of the cross-section.

The invention in this embodiment thereby goes against the advice and standard commonly used in the art in that a substantially higher percentage of reinforcement is used and is utilised. It is possible with the inorganic layer comprising ultra fine particles to make this inorganic layer so compact that it will be possible to transfer a substantially larger amount of force to the reinforcement than what is possible with traditional constructions. This in turn provides an altogether stronger sandwich construction. Furthermore, by also adding fibres to the inorganic matrix the ductility of this, and thereby of the entire construction, is increased such that the sandwich construction as a whole will better be able to withstand dynamic stresses.

In a further advantageous embodiment the fibre content constitutes 1% to 35% by weight of the inorganic layer, more preferred 1% to 20% by weight of the inorganic layer and most preferred 2% to 12% by weight of the inorganic layer. Again as with reference to the embodiment mentioned above these fibre contents are outside the traditional ranges for fibre reinforcement. It is, however, again possible, due to the fact that ultra fine particles are mixed into the inorganic layer, to utilise these high fibre contents in order to achieve a very ductile construction and at the same time a very dense, also substantially crack-free, inorganic layer. Also due to the contact layer, the forces to which the construction is exposed, will be evenly transferred to the underlying steel construction.

In a further advantageous embodiment the inorganic layer also comprises a coarse aggregate having an aggregate size between 2 mm and 22 mm, more preferred 3 mm and 16 mm and that the grading is in intervals having grain sizes of 2-5 mm, 3-6 mm, 5-8 mm and/or 8-11 mm. Tests have shown that the coarse aggregate will be able to constitute part of the dense matrix with the ultra fine particles such that almost no voids and thereby no crack inducing pathways will be formed in the matrix. Furthermore, due to the compactness of the entire matrix the traditional requirement of 4% air content in order to render the concrete (composite construction) frost resistant is not required in that the inorganic layer is so dense and compact that water will not be able to penetrate and give rise to the normal detrimental effect of the frost-thaw cycle.

In a further advantageous embodiment the inorganic layer comprises a coarse aggregate constituting 25% to 75% by weight of the inorganic layer, more preferred 30% to 65% by weight of the inorganic layer and that the aggregate is chosen from or as a combination of basalt, granite, bauxite korund or similar type of broken aggregates.

By being able to pack ultra fine particles around the coarse aggregate and having a rather high content of coarse aggregate mainly chosen from hard rocks such as basalt, granite, bauxite or korund, an altogether very strong matrix is provided. As the matrix itself is very strong and the capability of transferring tension through the fibres and the reinforcement to the contact layer and the underlying steel plate construction, an altogether strong and ductile construction is provided.

In a still further preferred embodiment the inorganic layer comprises, in addition to the binder, a fine aggregate fraction having particles between 0 mm and 4 mm, more preferred particles between 0 mm and 2 mm and that the fine aggregate fraction comprises one of the following: silica sand, river sand, calcium filler, bauxite or other aggregates of good quality.

Examples of composite materials which fulfil the requirements above are various cement based composite materials available from Contec ApS, Aarhus, Denmark.

Of course, particles having a size of 0 mm are non-existent. However, it is generally accepted in the art that particles constituting part of a microsilica as well as the fly ash have a size which is so small that they approach 0 mm. For the constitution of the extremely dense matrix which is achieved by this embodiment, these particles will fill out voids in the matrix which otherwise would be open and thereby not able to add to the entire strength picture of the complete construction. For this reason it is desirable to have particles of all sizes in that the composite material in this way will be extremely compact and dense and thereby achieve the features of a very dense structure being extremely ductile and strong and at the same time being able to transfer forces from the inorganic layer to the reinforcement and to the underlying steel plate construction via the contact layer.

In a further advantageous embodiment the water/binder ratio is between 0.15 and 0.45, more preferred between 0.20 and 0.40 and most preferred between 0.25 and 0.35.

In this connection it should be mentioned that with the water/binder ratio the water can be compensated by adding plasticizers which usually have an equivalent water content such that the actual water in the matrix can be lowered. Also, by adding the plasticizers it will be possible to achieve a more flowable construction such that the inorganic layer can have a viscosity whereby it can be achieved that in practise on site it is assured that the reinforcement is complete encapsulated in the inorganic layer.

Furthermore, in an advantageous embodiment the binder is a cement, a combination of cement and micro silica and the cement is preferably a white cement. As is well known in the art the white cement types are usually finer grained, purer and thereby able to achieve higher strength that the ordinary grey cements. Furthermore, by the addition of micro silica a secondary strength component is achieved such that the entire matrix comprising white cement and microsilica together with for example the hard aggregates as mentioned above, creates an extremely strong inorganic layer.

The air content adjusting additives and/or super-plasticizers or other water reducing agents are added to the materials in the inorganic layer during the dry mixing stage of the binder and the ultra fine particles. For traditional concretes this is normally done by mixing additives into the concrete at the mixing stage in the batching plant. These premixes containing air content adjusting additives or water reducing agents, subsequently will be activated by the addition of water to the dry matter. It has, been found that the matrix according to the invention achieves a better homogeneity and thereby also a better packing of the small particles when the additives are premixed to the binder although it can also be added, as a liquid or powder, during the mixing of the inorganic layer in the concrete batching plant or on the building site.

Turning now to the contact layer in a further advantageous embodiment of the construction the contact layer comprises an epoxy, polyurethane, bitumen based or bitumen modified emulsion or acrylic based material having a layer thickness between 0.2 mm and 5 mm, more preferred between 0.5 mm and 3.5 mm and most preferred between 0.7 mm and 2.5 mm and that said layer comprises rock particles having a size between 0.5 mm to 8 mm, preferably 1 mm to 6 mm and that the rock is chosen from bauxite, quarts, granite, korund or similar type of strong aggregates.

In principle, any material can be used for the contact layer provided that the necessary adhesion can be achieved between the layers.

As mentioned above adhesives used for the contact layer can advantageously be chosen among epoxy and/or polyurethane based materials such as Sikadur 30 from the Sika Corporation or Araldit 2015 or Europoc 730 with hardener Eurodur 450 obtainable from CIBA, Switzerland or Edilon EPX manufactured by Edilon.

When the contact layer material is applied to the steel plate surface a very good adhesion between these two materials will be achieved. Furthermore, using the above mentioned layer thicknesses in co-operation with the rock particles (sand) and especially when the rock particles have non-rounded shapes, these will project outside the contact layer. When the inorganic layer is applied on top of the contact layer, these rock particles will be half embedded in the epoxy and half embedded in the inorganic layer whereby an effective bond between the contact layer and the inorganic layer is achieved. This facilitates the transferral of forces from the inorganic layer via the contact layer to the underlying steel construction and thereby provides for the advantages listed above.

Tests have shown that the forces needed to pull the layers apart perpendicular to the plane of the contact layer is between 2 $N/mm^2$ and 5 $N/mm^2$. It is essential for achieving the novel and inventive characteristics of the invention that the minimum pull force is more than 0.75 $N/mm^2$.

In a preferred embodiment of the invention the inorganic material layer has a thickness between 5 mm and 150 mm, more preferred between 10 mm and 110 mm and most preferred between 15 mm and 85 mm.

It has shown that applying the inorganic material with the embedded reinforcement having a contact layer as described above such that forces effectively can be transferred to the underlying steel plate or steel construction, creates a very homogenous and strong sandwich construction. Normally, for concrete structures being exposed to the environment a concrete cover of 50 mm is prescribed in order to provide sufficient protections against the detrimental effects of chloride, water, $CO_2$ to the reinforcement is required. However, with the dense matrix of the inorganic material, very thin inorganic material covers are necessary in order to protect the reinforcement from the detrimental effects from the climate. The main object of the inorganic covering is to be able to transmit forces and distribute forces in the inorganic layer. Due to the composition of the inorganic layer as disclosed above, the inorganic layer will be very dense and compact and thereby effectively hamper the ingression of water, chlorides and $CO_2$. By being able to create a strong construction having such a compact and dense structure, the sandwich construction can be utilised for a number of purposes without having to alter the entire construction as such. When for example renovating bridges the layer can be applied directly onto the bridge deck since the weight of this layer is so insignificant in comparison to normal constructions/paving that no extra reinforcement of the underlying structure is necessary. Furthermore, the entire construction comprising such a layer having the good characteristics as mentioned above will positively add to the strength of the entire construction.

The invention also comprises a method for making a construction as stated above, wherein the following steps are carried out: A steel plate is placed substantially horizontally, optionally the surface of the steel plate is cleaned, for example by a sand blasting process and a contact layer is applied to the steel plate surface in a thickness of 0.3 to 1 mm. While the contact layer is still wet, rock particles having a size between 0.5 mm to 8 mm, preferably 1 mm to 6 mm and in that said rock particles are chosen from bauxite, quartz, granite, korund or similar strong aggregates, are distributed on the contact layer surface, an inorganic material comprising a binder, fine and coarse aggregate is cast on the surface of the contact layer, optionally wet-in-wet, and the construction is allowed to cure.

In this fashion a construction of a sandwich like composite element can be carried out in situ. The substantially horizontally placed steel plate can for example be the deck of a ship, the deck of an oil platform or a bridge deck. With the invention it is possible to cast and produce a construction as described above on slightly inclined surfaces in that the viscosity of the entire composite material can be adjusted such it will substantially remain in place after being cast.

Furthermore, although the invention is mainly described with respect to being arranged in connection with steel plates, the sandwich construction can also be carried out on aluminium, carbon board, MDF-plate, polymer-plate, wood/timber, concrete, plastic, or a semi-flexible surface with corresponding effects in tension.

In an alternative embodiment of the method as described above, the contact layer is allowed to cure/harden and reinforcement bars or rods are arranged on said contact layer prior to casting the inorganic material layer onto the surface of the contact layer. It is also contemplated within the scope of the invention that the reinforcement can be pre-manufactured and laid out in sections just prior to casting the inorganic layer.

There are some advantages connected with this type of manufacture in that the reinforcements will not be exposed to moisture prior to being placed and being surrounded by the inorganic layer such that the corrosion in the shape of rust will not be present in the entire construction. The oxidisation of the steel producing ferrite can create a surface layer on the steel reinforcement with less contact to the steel whereby the contact between the inorganic layer and the steel reinforcement is lowered. The occurrence of rust can also be minimized by sand-blasting the reinforcement just prior to casting the inorganic layer. In this case, however, where there is such a high reinforcement percentage, it can be difficult to achieve a thorough cleaning of all surfaces of the reinforcement bars, but it must at the same time be realised that sand-blasting will clean the surfaces of the steel where exposed and thereby assure a better co-operation between the inorganic layer and the reinforcement than without the sand-blasting.

In a further advantageous embodiment the inorganic material comprises fibre reinforcement. It is well-known that fibre reinforcement adds ductility to a structure. In this instance this is further improved by the fact that the inorganic layer via the contact layer transfers and directly interacts with the steel plate such that a substantially homogeneous force absorbing structure is created, whereby the fibre content in the inorganic layer serves more purposes than just providing ductility, it also provides for a more distinct force distribution in the matrix as well as minimising the shrinkage of the inorganic layer thus resulting in a better crack development.

As this construction principle is new, the standards governing for example renovation of bridge decks or ship decks may require that the reinforcement bars or rods are connected to the steel plate through the contact layer by means of steel anchors. The invention, therefore, provides that the steel anchors can be installed prior to applying the contact layer. Although the steel anchors or studs as described above have a detrimental effect on a traditional concrete layer, with the inorganic layer as described above the same problems do not arise due to the ductility and compactness of the inorganic layer. Furthermore, as the contact layer will transfer especially shear forces from the steel to the inorganic layer contrary to the traditional constructions of this type there will not be a build-up of forces/stress around the steel anchors/studs.

In order to further promote a homogeneous inorganic material layer the invention in a further advantageous embodiment provides for a curing membrane, plastic sheets or other evaporation protective coverings to be installed covering the inorganic material layer. A curing membrane or other protective coverings are usually used in order to hinder the evaporation of water from the surface of a hardenable material such as concrete. During the hardening process of concrete, the free water present in the pores or absorbed in the particles will over time interact with the components of the cement and thereby be transformed into crystalline water or absorbed water. This type of water is chemically bound and cannot easily be removed from the structure. In the present case, however, since the water content is very low and the matrix very dense and compact, evaporation will only occur from the uppermost thin layer of the inorganic material and the effect of such a curing membrane is therefore primarily to ensure that the finished surface of the structure will have the best characteristics possible. Since the surface of the inorganic layer is so dense and compact, it is not necessary to provide a pavement or further finishing, but the finished inorganic layer can be utilised as the working surface or driving surface in the case of a bridge deck.

In a further advantageous embodiment of the invention the inorganic material comprises 25 kg ultra high strength binder based on white cement, 40 kg sand, quartz and/or bauxite having a particle size between 0 mm and 2 mm; 50 to 75 kg aggregate, having particle sizes between 2 mm and 5 mm; a fibre content of less than 20%; and a water/cement ratio between 0.15 and 0.40 by weight; and optionally air void regulating substances, super-plasticizers, or other additives.

The construction as described above as well as the method may be used in a construction where the construction is applied to a steel plate, where the steel plate is a bridge deck, ship deck, oil platform or another off-shore facility, a staircase, balcony, carpark deck or other load-carrying steel structure.

Due to the characteristics as mentioned above and especially the ductility and good contact whereby a force transferring possibility is provided between the steel structure and the inorganic layer, the inventive sandwich-like plate construction according to the invention can advantageously be used for renovating or reinforcing structures which are exposed to dynamic loads.

The method according to the invention can also be used for local repairs.

Usually, the stress distribution in for example bridges will be concentrated in particular places or distinct spots, such as around beams, fastenings, welds or other such places. It is possible to restrengthen/replace the existing construction. If for example a crack has occurred in the underlying steel construction, traditionally a new steel plate is arranged covering the damaged area. The plate can for example be welded onto the underlying construction. This type of repair is often referred to as using a splint (the steel plate).

With the new inventive method the underlying surface is cleaned, for example by sand blasting, the contact layer is applied, whereby a strong adhesion between the underlying construction and the inorganic layer placed over the contact layer can be achieved. Depending on the character of the surrounding construction, the substantially vertical sides of the cut limiting the repair area can also advantageously be coated with the contact layer. In this manner the inorganic layer is the splint. Hereby is in addition to locally strengthening the construction also achieved that the inorganic layer is integrated in the existing construction, and therefore creates a substantially uniform stress distributing construction.

Above a number of applications have been mentioned where the inventive principle of applying a composite material to a surface having a contact layer has been described. It should, however, be noted that the invention as such is not limited to these applications only.

Within the scope of the present invention further applications may also be contemplated. Below a few examples, not limiting the invention, but merely illustrating the wide field of possible applications, is described.

For safety reasons more and more commercials ships, especially ships carrying liquids such as chemicals, oil and the like, are required to have double hulls such that in case of an accident the environmental impact may be minimized in that the ship structure, due to the double hulls, should be strong enough to withstand hidden rocks, cliffs and the like. As it will take a number of years to replace the entire commercial fleet of this type of carriers, the present single hull ships may be reinforced by applying the composite construction according to the invention at least to sections below the waterline. Furthermore, due to the very dense characteristics of the composite material as well as the adhesive used for the contact layer, an extremely durable and long-lasting subsurface treatment, and thereby protection of the hull surface, would be obtained.

With the ever increasing size of wind turbines and thereby the towers necessary for elevating the nacelles of the wind turbine, the construction costs, transportation and mounting costs involved in erecting these towers are also ever increasing. Furthermore, in order to provide the necessary strength and stiffness in the tower structure, special strengthening construction within the tower must be provided. With the present invention, however, it is possible to erect a relatively thin-walled steel tower and thereafter, either during the erection phase or after erecting the tower, but before the nacelle is installed, to firstly place the contact layer either inside or outside the tower construction and thereafter apply the composite material, for example in a fibre-reinforced embodiment, onto the contact layer. In this manner, the tower structure is stiffened and strengthened in situ such that very tall tower structures may be economically feasible.

A different problem, also related to the erection of wind turbines, is the manufacture of foundations. More and more wind turbine farms are placed off-shore such that the environmental impact or impact on the scenery will be minimised as much as possible and the wind condition are more reliable. Erecting wind turbine farms off-shore, however, may be very costly in comparison to erecting wind turbines on shore. By utilising the extreme strength characteristics of the composite material in combination with for example a steel plate, the transportation costs of even rather large foundation structures may be kept low. One of the problems with foundations for wind turbine towers is the fact that in order to minimise the transferral of forces to the ground, the foundation structure must have a certain area in relation to the size of the turbine tower. With the present invention it becomes possible to manufacture rather large area foundations at a relatively low cost, which at the same time, due to the inventive construction where for example the tension characteristics of the steel is utilised completely in combination with the compressing characteristics of the composite material such that, with a relatively low weight, relatively high forces may be transferred through the foundation structure and into the ground at the appropriate place, for example via a pile foundation.

A further application where the inventive concept has shown some inventive advantages is in the manufacture of furniture. The composite material may be provided with different characteristics such that for example for use on an outside patio, a kitchen element may be designed where part of the kitchen top surface etc. may be designed as a barbeque, where the inorganic composite material is provided with fire-resistant properties and in the same element a kitchen sink may be provided. Even though the barbeque will induce stresses in the material due to the heat expansion properties of both the composite material and the underlying tension member which in the actual furniture was a steel plate, no cracks due to the difference in temperature appeared in the kitchen element. On the other hand, due to the material properties, especially relating to frost/thaw durability, the kitchen element could withstand the outdoor environment without any problems. Also, furniture such as benches, chairs, bookcases, tables etc. have been manufactured according to the inventive principle where the overall constructions thickness was between 5 and 10 mm, which in addition to providing outstanding strength and durability properties also provides for a large degree of freedom for the designer. This has made it possible to manufacture furniture with very interesting designs. Due to the properties relating to durability, frost, thaw and temperature resistance, pre-manufactured kitchen units, table tops etc. may also be manufactured with the present invention. As the composite material surface is very smooth, which also is the case for the steel surface, a wide variety of surfaces may be provided simply by either keeping the surfaces raw, i.e. without any surface treatment, or they may be treated in any appropriate manner known in the art for treating cement based composite materials or steel plates.

In a further application a flooring system has been developed wherein floor boards are assembled in order to provide the flooring. A floor board is constructed by having a tension plate of steel, aluminium or plastic shell, for example 0.1 to 1.5 mm thick, bent or formed into a U-shaped cross-section. Inside the U-section, a contact layer is applied to all surfaces of the tension plate. Thereafter, the composite material is placed inside the U-section such that the composite material layer is thicker than the upstanding sections of the tension plate U. Furthermore, the composite material is kept at a distance from the sides of the upstanding U such that between the U-sections' upstanding flanges and the composite material a free space is provided. By laying two such floor boards next to each other, two upstanding sections of neighbouring U-sections will be assembled, for example by a steel clip, whereafter an appropriate joint filler material or profile may be applied into the space between the composite material and the upstanding section of the U. The joint between two composite floor boards of this type may be made as narrow as 2 to 3 mm. Furthermore, due to the durability of the composite materials, such a floor has extreme wearability properties and, furthermore, due to the inventive assembly of two floor boards by the clips, by removing the joint filler material or profile and removing the clips, the floor boards may be removed and reused or re-laid somewhere else.

Finally, it is evident that using the inventive concept of having a tension element, for example a steel plate, provided in a connection being able to transfer shear forces such as it is the case with the inventive contact layer of the present invention to a compression strength layer, for example a cement based composite material, does comprise obvious advantages when it comes to manufacturing and constructing traditional constructional elements such as stairs, stair cases, platforms, landings, beams, pillars, pipes etc. The adhesion between the composite material and the contact layer and the contact layer and the steel is explained very well above. Therefore, the inventive concept may also be utilised for the manufacture of shipping containers, where high impacts usually may be experienced. This also provides for the manufacture of construction elements for explosion-safe containers, strong boxes, guard houses, protective barriers for values or human beings or other constructions where it might be desirable to utilise these specialised characteristics.

The wear properties of the composite materials is well-known in the art such that in pipe lines it is known to reinforce bends and turns by applying a wear-resistant layer such as for example a composite material. By applying the composite material in a manner as described in connection with the present invention, further advantages are achieved. Due to the extreme adhesion between the contact layer and steel, respectively the composite material, a pipe line protected with such a composite layer will, in addition to the wear properties, also be very long-lasting in that vibrations and shock waves arising in pipe line systems of this type will not affect the adhesion, which is provided by the contact layer. Therefore, a very long-lasting and very durable solution is provided by using the present invention.

During the development of the inorganic layer a number of different mixtures were developed. In the table below a number of compositions of inorganic layers having the characteristics and advantages as stated above are listed.

Typical Mixtures

The coarse aggregate in the interval 2-16 mm, typically 2-8 mm consist of: 20-75 weight % of the total composite mass, typically 35-55 weight %. 30-65 volume % of the total composite material, typically 35-55 volume %.

| Components | Laboratory | Weight % | Liter | 1 $m^3$ |
|---|---|---|---|---|
| Contec Binder ® | 25.00 kg | 22.22% | 8.93 liter | 638 kg |
| Quarts 0-2 mm | 35.00 kg | 31.11% | 13.46 liter | 893 kg |
| Granite 5-8 mm | 40.00 kg | 35.56% | 14.81 liter | 1020 kg |
| EE glass or PP fibres | 0.50 kg | 0.44% | 0.45 liter | 13 kg |
| Steel fibres | 12.00 kg | 10.67% | 1.54 liter | 306 kg |
| Mixture | 112.50 kg | 100.00% | 39.20 liter | 2870 kg |
| Contec Binder ® | 25.00 kg | 20.10% | 8.93 liter | 564 kg |
| Quarts 0-2 mm | 40.00 kg | 32.15% | 15.38 liter | 902 kg |
| Bauxite 5-8 mm | 50.00 kg | 40.19% | 18.52 liter | 1127 kg |
| EE glass or PP fibres | 0.40 kg | 0.32% | 0.36 liter | 9 kg |
| Steel fibres | 9.00 kg | 7.23% | 1.15 liter | 203 kg |
| Mixture | 124.40 kg | 100.00% | 44.35 liter | 2805 kg |
| Contec Binder ® | 25.00 kg | 18.83% | 8.93 liter | 523 kg |
| Quarts 0-2 mm | 40.00 kg | 30.12% | 15.38 liter | 837 kg |
| Basalt 3-68 mm | 60.00 kg | 45.18% | 22.22 liter | 1256 kg |
| EE glass or PP fibres | 0.30 kg | 0.23% | 0.27 liter | 6 kg |
| Steel fibres | 7.5 kg | 5.65% | 0.96 liter | 157 kg |
| Mixture | 132.80 kg | 100.00% | 47.77 liter | 2780 kg |
| Contec Binder ® | 25.00 kg | 17.16% | 8.93 liter | 472 kg |
| Quarts 0-2 mm | 40.00 kg | 27.46% | 15.38 liter | 756 kg |
| Granite 2-5 mm | 75.00 kg | 51.49% | 27.78 liter | 1417 kg |
| EE glass or PP fibres | 0.15 kg | 0.10% | 0.14 liter | 3 kg |
| Steel fibres | 5.50 kg | 3.78% | 0.71 liter | 104 kg |
| Mixture | 145.65 kg | 100.00% | 52.93 liter | 2752 kg |
| Contec Binder ® | 25.00 kg | 16.22% | 8.93 liter | 443 kg |
| Quarts 0-2 mm | 40.00 kg | 25.96% | 15.38 liter | 709 kg |
| Quarts 2-4 mm | 85.00 kg | 55.16% | 31.48 liter | 1507 kg |
| EE glass or PP fibres | 0.10 kg | 0.06% | 0.09 liter | 2 kg |
| Steel fibres | 4.00 kg | 2.60% | 0.51 liter | 71 kg |
| Mixture | 154.10 kg | 100.00% | 56.40 liter | 2732 kg |

For precast elements or complicated castings with the inorganic composite material, using the present invention, the inorganic composite material might need to be free flowing using a recipe that could be as follows:

| Components | Laboratory | Weight % | Liter | 1 $m^3$ |
|---|---|---|---|---|
| Contec Binder ® | 50.00 kg | 45.41% | 18.52 liter | 1320 kg |
| Bauxite 0-1 mm | 30.00 kg | 27.24% | 9.68 liter | 792 kg |
| Basalt/Bauxite 2-6 mm | 25.00 kg | 22.71% | 8.93 liter | 660 kg |
| EE glass or PP fibres | 0.11 kg | 0.10% | 0.10 liter | 3 kg |
| Steel fibres | 5.00 kg | 4.54% | 0.64 liter | 132 kg |
| Mixture | 110.11 kg | 100.00% | 37.87 liter | 2907 kg |

The main reinforcing consists of 5-35 weight % of the total composite mass, typically 6-20 weight %.

The main reinforcing consists of 1-12 volume % of the total composite mass, typically 2-7 volume %.

| Main reinforcement | Weight % | Volume % |
|---|---|---|
| 4 kg 25 mm | 6.15% | 2.05% |
| 6 kg 30 mm | 7.41% | 2.56% |
| 8 kg 35 mm | 8.42% | 2.93% |
| 12 kg 45 mm | 9.60% | 3.42% |
| 18 kg 50 mm | 13.33% | 4.62% |
| 35 kg 70 mm | 18.42% | 6.41% |

The fibre reinforcement consists of 1-20 weight % of the total composite mass, typically 2-12 weight %.

The fibre reinforcement consists of 0.5-9 volume % of the composite material, typically 1-6 volume %.

| Fibre reinforcement | Weight % | Volume % |
|---|---|---|
| 306 + 13 kg/2870 kg | 11.12% | 5.10% |
| 203 + 9 kg/2805 kg | 7.56% | 3.42% |
| 157 + 6 kg/2780 kg | 5.86% | 2.56% |
| 104 + 3 kg/2752 kg | 3.89% | 1.61% |
| 71 + 2 kg/2732 kg | 2.67% | 1.09% |

During the development of the present invention a full scale test was carried out. A steel plate being a section of a bridge deck was sand-blasted and degreased such that the steel surface was absolutely free from foreign matter, corrosion products, oil etc.

A two-component, epoxy based material such as Leycochem epoxy from the firm Contec ApS, Denmark, was thereafter applied to the surface. The layer thickness of the epoxy based material constituting the contact layer was between 1-3 mm. After applying this layer and while the layer was still wet, bauxite having an uneven particle shape and grain size of 3-6 mm was spread onto the non-hardened epoxy based surface. During the applying of the bauxite a surplus amount of material was used such that it was achieved that approximately the entire surface of the contact layer was covered by bauxite. After the contact layer has hardened the loose surplus of bauxite was removed with a brush.

The following step was to place the reinforcement. Three layers of reinforcement where the rods varied between 8 mm and 15 mm diameter were arranged perpendicular to each other with a slight displacement such that the uppermost reinforcement was displaced 25 mm horizontally in relation to the bottommost layer. The bottom layer was kept 8 mm from the bauxite by means of distance keepers.

After the reinforcement was placed, the inorganic material was placed and vibrated into position among the reinforcement and in close contact with the bauxite in the contact layer. The inorganic material used in the process comprised a high strength binder based on white cement type CEM1 52.5®, micro silica, polypropylene fibres, super-plasticizer, air reducing additives as well as an additive for reducing the surface tension, sand having a grain size between 0.1 to 1.5 mm, granite having a maximum size of 5 mm, steel fibres having a diameter of 0.4 mm and an average length of 12.5 mm with a characteristic strength of 1200 $N/mm^2$, approximately 70 $kg/m^3$. The water/binder ratio was between 0.32 and 0.35. In addition to applying the inorganic layer to the bridge deck, samples for testing were also manufactured. The test samples showed a 28 day compression strength of 117 $N/mm^2$, for cubes and prism 84 $N/mm^2$.

The modulus of elasticity at 28 days maturity was determined to 47200 $N/mm^2$.

The shrinkage up to 90 days at 20° C. and 50% relative humidity was also determined. The test showed that shrinkage between $0.25\times10^{-3}$ and $0.30\times10^{-3}$ was achieved. These values are substantially lower then what could be expected from normal high strength concrete.

The essential characteristics of these constructions are the connection between the steel plate and the inorganic layer via the contact layer. In order to be able to transfer stresses through the contact zone, it is extremely important that the sandwich construction acts as a homogeneous construction. In order to verify this, tests were carried out where a cross-section of the sandwich construction, i.e. the steel plate, contact layer and inorganic layer, were pulled apart. This was carried out by attaching the pulling members to the steel plate and the surface of the inorganic layer, respectively. Pull strength indicated that the bond/stress was between 2.48 and 3.23 $N/mm^2$ (average 2.96 $N/mm^2$) when granite was applied to the wet epoxy surface, for bauxite higher values were found namely 4.15-5.12 $N/mm^2$ (average 4.81 $N/mm^2$).

In praxis a more interesting aspect of the bonding strength is the ability for the entire construction to resist shear arising due to bending moments. For this purpose bending tests were carried out. When bauxite was used in the epoxy layer, strengths of 12.5 $N/mm^2$ were found and for granite the corresponding figure was 11.2 $N/mm^2$.

Furthermore, when this method and construction is used for renovating bridges, decks on ships, oil platforms and the like, the dynamic performance of the entire construction is very interesting. For this purpose dynamic tests were carried out on two sets of cut-out sections of a bridge deck, each being 2 $m^2$. A test cycle where the simulated wheel load pressure was 105 kN was performed 4.2 million times and 3 series, each comprising 1.4 million times load of 136.5 kN and 168 kN or/and 210 kN were also applied. Furthermore, a static load of 400 kN was also applied. After the test the samples were examined and they showed no signs of fatigue, delaminating or fracture. The total amount of loads added during the tests corresponds to 276 years of loads under normal traffic conditions on a highway bridge.

Furthermore, tests relating to the salt ingress and the chloride ingress were also performed. In order to register the resistance against salt ingress, a salt solution of 3% wherein the temperature varied in cycles of 12 hours between −20° C. and +20° C. After 28 cycles, the results were remarkable and substantially lower than what could be expected for comparative concrete. The chloride ingress was determined by cutting slices off the test samples mentioned above after respectively 1 and 6 months. By chemical analysis it was determined that no chloride ingress had occurred apart from in the uppermost 1 or 2 mm of the concrete layer. This ingress can be due to normal surface defects.

In conclusion the field tests showed very good bonding strengths between the different layers, whereby extremely high bending stresses could be absorbed in the construction without damaging the sandwich constructions and that the durability due to the non-existing crack formation and the co-operation between the reinforcement, fibre reinforcement and contact layer was convincing in such a way that a much improved construction may be achieved in this manner.

DESCRIPTION OF THE DRAWING

In FIG. 1 the underlying steel construction 1 is in this embodiment illustrated as a trapezoidal construction. On the top side 2 of the steel construction the contact layer is arranged (not shown—see FIG. 2). Hereafter the reinforcement 3 is arranged, in this example three layers. Between the top side 2 of the steel plate and the underside of the reinforcement 3 distance keepers are arranged (not shown). The reinforcement can advantageously be pre-made welded nets, for example ø 10 mm. Finally, the composite material 4 is placed and vibrated into place. Optionally a curing membrane may be applied to the top side.

Turning to FIG. 2 the contact layer 5 is illustrated. On the top side of the steel plate 2 a contact layer, for example an epoxy based binder such as Leycochem epoxy from Contec ApS, is placed. The layer thickness is approximately 2 mm. Thereafter rock particles 7 are applied to the still wet binder 6. The rock particles will sink into the binder. By selecting the sizes of the particles larger than the layer thickness it is assured that at least some if not all particles will be exposed over the surface of the binder. By applying the particles to the binder the binder layer thickness will increase. As the composite material is applied to the hardened contact layer, it will also bind to the rock particles and a very strong connection will be created. Furthermore, the strength against shear forces, i.e. forces parallel to the steel plate surface, is very high due to the strength of the rock particles and their bond to the epoxy based binder.

FIG. 3 shows a furniture plate 8 consisting of an aluminium plate 9 onto which an inorganic composite material 10 is deposited. In order to create a bond between the two layers as described above, an epoxy has been applied at the interface between the aluminium plate 9 and the composite material 10 and such that a silica sand 11 has been partly embedded in the epoxy layer as described with reference to FIG. 2.

In FIG. 4 a cross-section through a ship hull 12 is illustrated, where the outer skin of the ship hull has been applied with an inorganic composite material according to the invention. The enlarged section of the ship hull illustrates the steel plate 13 traditionally comprising the ship hull exterior wall onto which the inorganic compound 10 has been applied by means of a contact layer consisting of for example an epoxy comprising a sand 11.

In FIG. 5 an armoured plate 14 for construction purposes is illustrated. The armoured plate 14 consists of a wooden board 15 at the back. It should, however, in this context be noted that the wooden board 15 may be replaced by a board from other materials such as for example reinforced plastics, ceramics, steel or other ductile materials. On the front side of the wooden board 15, an insulation layer 16 is applied. In the illustration, the insulation layer 16 is depicted as a hard insulation material, but any type of insulation material may be used. On the opposite side of the insulation material 16, a steel plate 17 is adhered. An epoxy layer is applied to the steel plate 17 into which an epoxy layer sand, for example in the shape of silicone carbide, is partly embedded as illustrated in FIG. 2. Thereafter, the inorganic composite material 10 is arranged, wherein the composite material a main steel reinforcement 18 is arranged. In this manner a very ductile and extremely strong plate construction is provided which will be resistant to almost any type of attack.

Turning to FIG. 6 a windmill 19 is illustrated having a tower structure and a foundation structure preferably made from steel. From the enlarged section both of the tower and the foundation structure it may be seen that the tower structure is built from a steel plate 20 onto which an epoxy layer is applied, in which a mineral sand is embedded such as for example silica sand 11 or the like in order to create the interface between the steel and the inorganic composite material 10. The inorganic layer is applied to the side of the steel which is exposed to compression forces in that the steel has excellent tension characteristics whereas the inorganic composite material has excellent compression characteristics. In this way, it is achieved that the best characteristics of the two materials are used when the construction is exposed to various conditions.

FIG. 7 illustrates a vertical construction element for facades or housing constructions in areas exposed to severe forces like tornadoes, thunderstorms, earthquakes or the like. The element 21 may advantageously comprise a plate member 22 such as for example a wooden board, steel plate, reinforced plastic plate or the like. On top of the plate member 22 an epoxy layer is applied, into which a mineral grain such as silicate sand, silicate carbide or the like 23 is embedded. Thereafter, the inorganic composite material 10 is applied to the epoxy layer with the embedded particles.

In the construction element 21 is furthermore illustrated that when the element is used in a facade, the interior walls 24 of the construction may be kept completely separate from the facade element 21. Optionally, an insulation 25 may be provided between the interior walls 24 and the facade element 21 of the wall construction.

Figure 8:
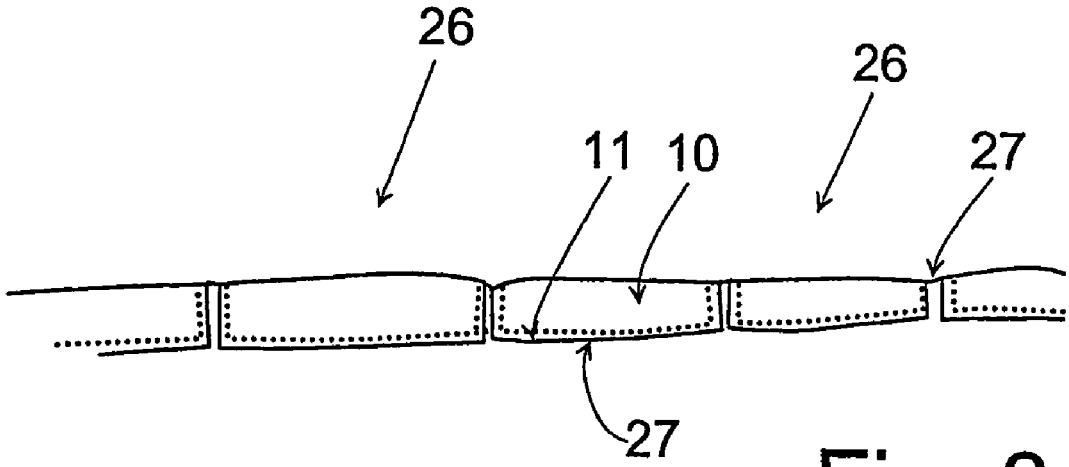
FIG. 8 illustrates a floor board.

In a still further embodiment as illustrated in FIG. 8, the invention may be applied to floor boards 26. The floor boards are constructed by providing a metal profile 27. The metal may preferably be bent into a U-shape such that an inorganic composite material may be cast into the U thus formed. A preferred metal may be aluminium or a thin stainless steel in that these are non-corrosive when exposed to humidity which may be present in the living environment.

The interior of the U-shaped profile is provided with an epoxy layer having partly embedded sand particles 11 such that a strong bond may be provided between the inorganic composite material 10 and the U-shaped metal 27.

In order to hold the individual floor boards 26 in position, a connecting profile 27 may be provided between two adjacent floor boards 26 in order to maintain these in a relative position. A floor comprising floor boards as described with reference to FIG. 8 has an extremely high wear resistance and at the same time the floor boards have an integrity and a load carrying strength which for many purposes makes them advantageous. Furthermore, due to the construction of casting the inorganic compound in the U-shaped profile and connecting the thus created floor boards by the profiles 27, it is possible to detach the floor boards and remove them for further use at appropriate places. Due to the inherent strength characteristics of both the inorganic composite material 10 and the metal profiles 27, the floor boards may be produced with a relatively high load carrying capability in comparison to their weight, i.e. the thickness of the floor boards.

Figure 1:
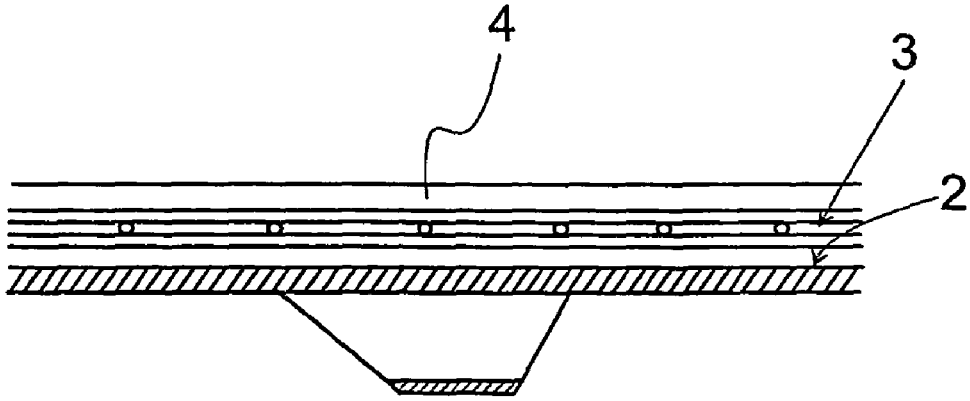
FIG. 1 illustrates a typical section through a deck construction.
Figure 2:
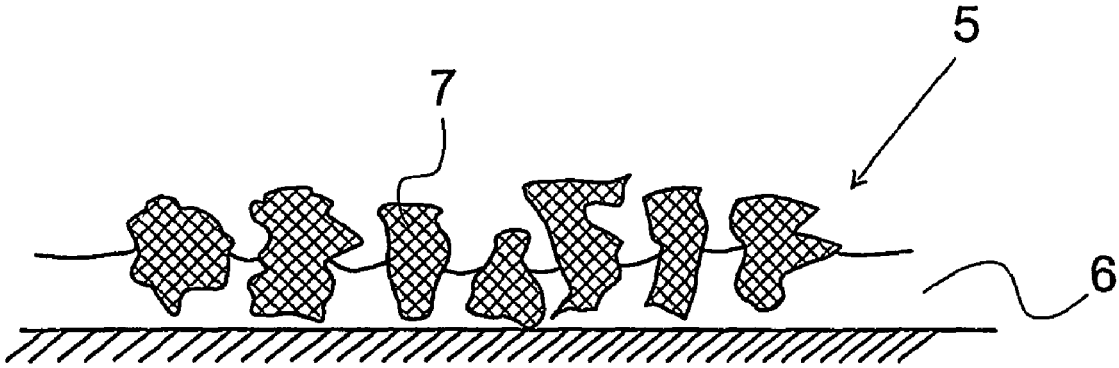
FIG. 2 illustrates a detailed view of the contact layer.
Figure 3:
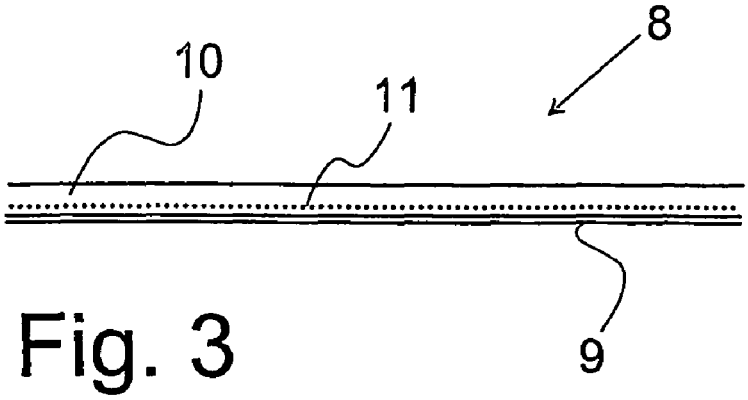
FIG. 3 illustrates a section through a furniture plate.
Figure 4:
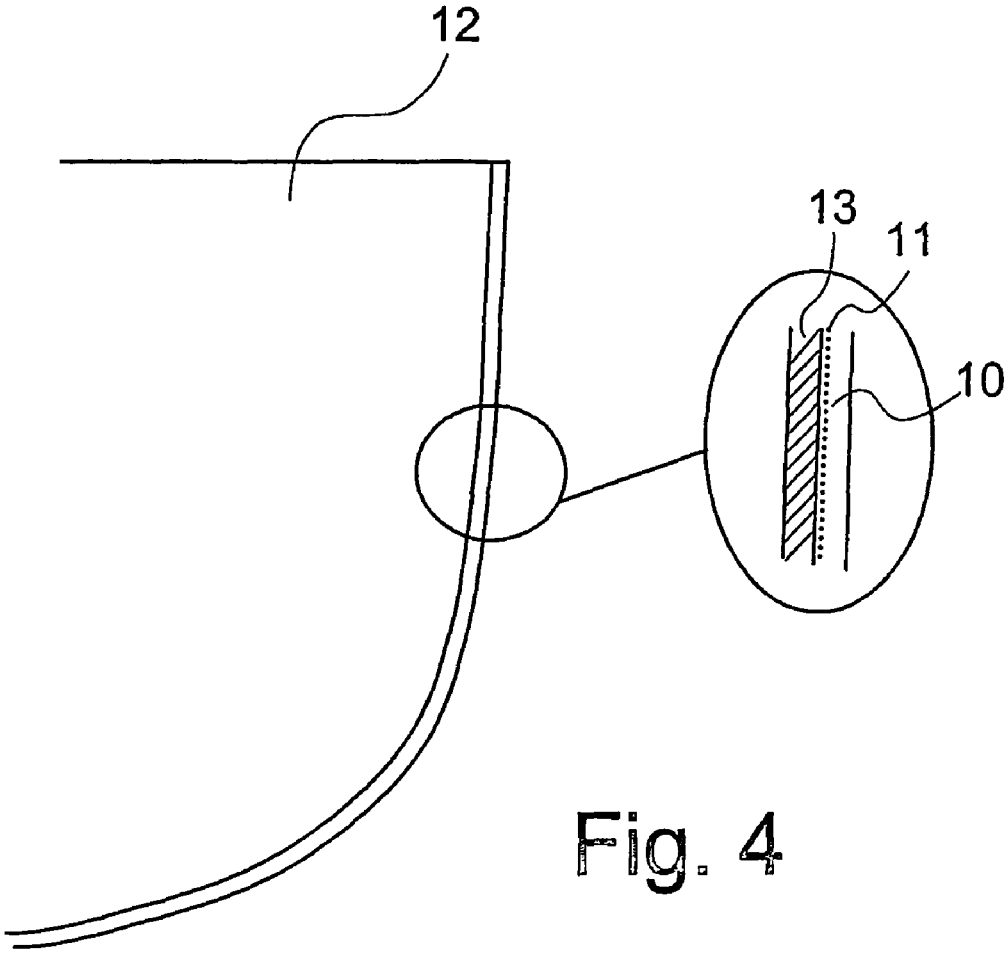
FIG. 4 illustrates the strengthening of a ship hull.
Figure 5:
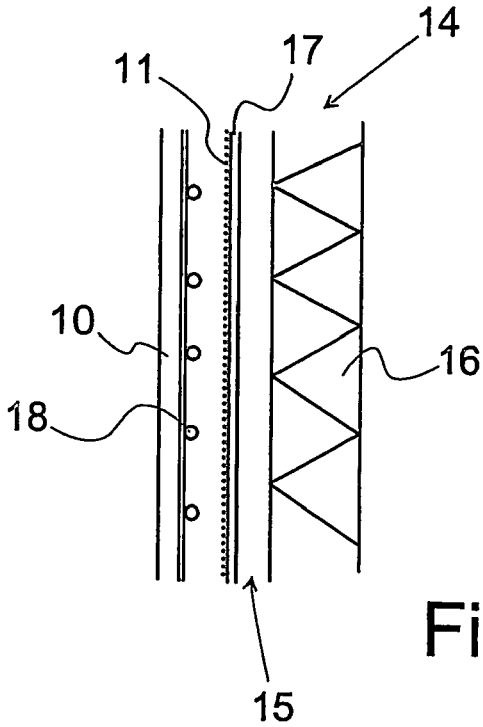
FIG. 5 illustrates an armoured plate for protection purposes.
Figure 6:
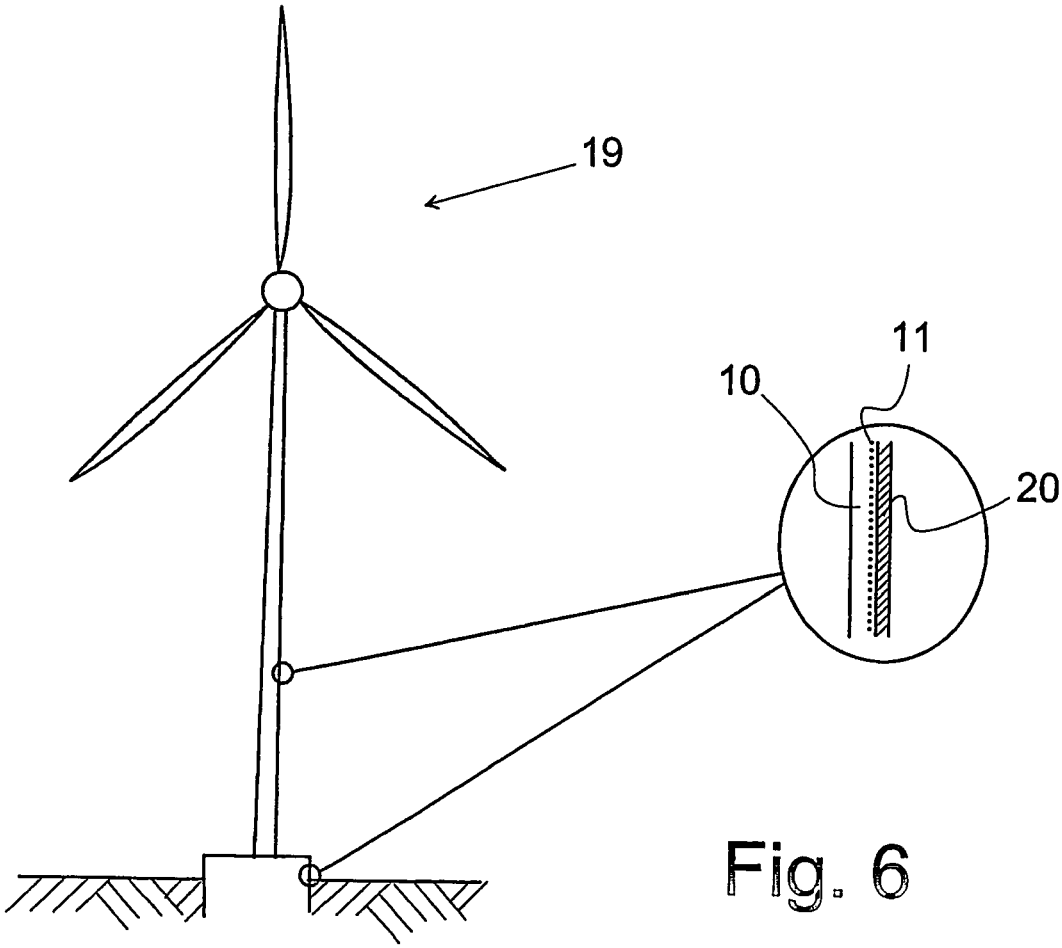
FIG. 6 illustrates a strengthening of a pipe or windmill construction.
Figure 7:
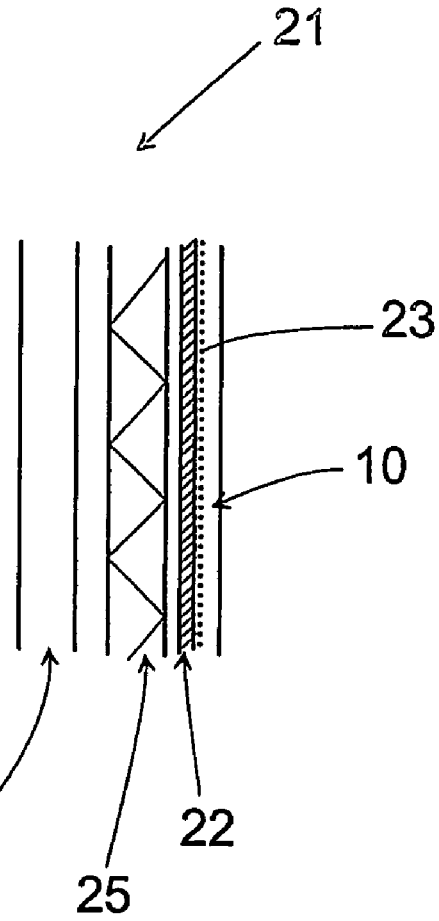
FIG. 7 illustrates a vertical construction element.
Figure 9:
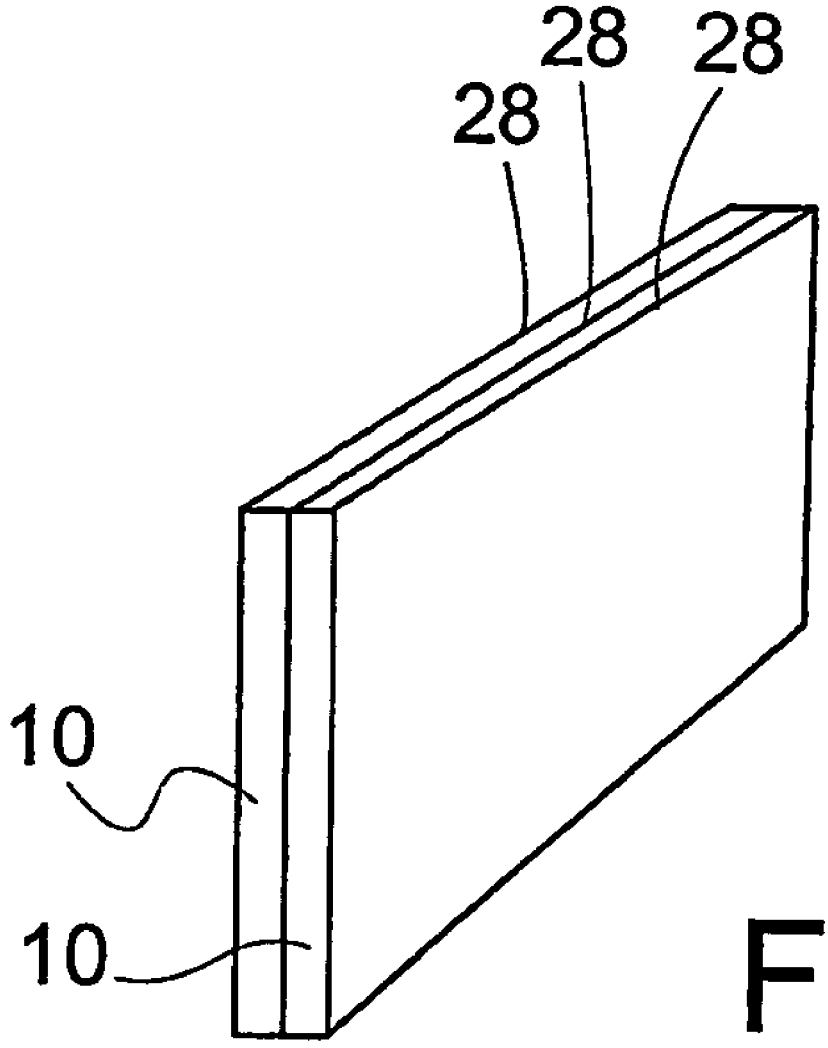
FIG. 9 illustrates a container element.

Turning to FIG. 9 a further embodiment illustrates a prefabricated element for cladding containers on the outside or inside in order to protect against damaging armoured attacks. The element consists of three layers of armoured steel plates 28 with the inorganic composite material provided in the spaces between the armoured plates 28. In order to create the intimate contact between the inorganic material 10 and the armoured steel plates 28, the interfaces are created as explained with reference to FIG. 2. A preferred sand material may be bauxite.

The invention claimed is:

1. Composite sandwich construction, comprising a tension plate, a contact layer applied to the tension plate, and a compression layer applied to said contact layer, said contact layer comprising an epoxy-based material or a contact glue having a bonding strength similar to that of an epoxy-based material, and said compression layer being an inorganic layer at least comprising ultra fine particles, water and a binder;

wherein the inorganic layer encapsulates a reinforcement, said reinforcement being steel bars or rods, carbon-, glass-, plastic and/or steel fibres, and wherein the reinforcement bars or rods constitutes 3% to 60% by weight of the inorganic layer.

2. Construction according to claim 1, wherein the fibre content constitutes 1% to 35% by weight of the inorganic layer.

3. Construction according to claim 1, wherein the inorganic layer comprises a coarse graded aggregate having an aggregate size between 1 mm and 22 mm, and wherein the grading is in intervals having grain sizes 2-5 mm, 3-6 mm, 5-8 mm and/or 8-11 mm.

4. Construction according to claim 1, wherein the inorganic layer comprises a coarse aggregate constituting 20% to 75% by weight of the inorganic layer.

5. Construction according to claim 1, wherein the inorganic layer comprises in addition to the binder a fine aggregate fraction, having particles between 0 mm and 4 mm and wherein the fine aggregate fraction comprises one or more of the following: silica sand, river sand, calcium filler, bauxite or other aggregates of good quality.

6. Construction according to claim 1, wherein the water and binder have a water/binder ratio that is between 0.15 and 0.45.

7. Construction according to claim 1, wherein the binder is cement, a combination of cement and micro silica.

8. Construction according to claim 1 wherein air content adjusting additives and/or super-plasticizers or other water reducing agents are added to the inorganic layer during its dry powder or wet mixing state.

9. Construction according to claim 1, wherein the contact layer has a layer thickness between 0.2 nun and 5 mm and wherein said layer comprises rock particles having a size between 0.5 mm to 8 mm and wherein the rock is chosen from bauxite, quartz, granite or similar types of strong aggregates.

10. Construction according to claim 1, wherein the inorganic material layer has a thickness between 5 mm and 150 mm.

11. Construction according to claim 1 wherein the steel plate is a bridge deck, ship deck, oil platform, windmill foundation or tower or other off shore facility, staircase, balcony carpark deck or other load carrying steel structure, protective barrier, construction element, floorboard, furniture plate or ship hull.

12. Composite sandwich construction, comprising a tension plate, a contact layer applied to the tension plate, and a compression layer applied to said contact layer, said contact layer comprising an epoxy-based material or a contact glue having a bonding strength similar to that of an epoxy-based material, and said compression layer being an inorganic layer at least comprising ultra fine particles, water and a binder; further comprising particles which are partly embedded in the contact layer and partly extend out of the contact layer, wherein the compression layer has been applied over the part of the particles which extend out of the contact layer so as to enclose them within the compression layer.

* * * * *

UNITED STATES PATENT AND TRADEMARK OFFICE

CERTIFICATE OF CORRECTION

PATENT NO. : 7,776,432 B2
APPLICATION NO. : 10/553444
DATED : August 17, 2010
INVENTOR(S) : Bo Serwin and Peter Buitelaar It is certified that error appears in the above-identified patent and that said Letters Patent is hereby corrected as shown below:

On the title page item (73), should read: Serwin Holding ApS, Højbjerg (DK)

Signed and Sealed this
Seventh Day of February, 2012

David J. Kappos

David J. Kappos
*Director of the United States Patent and Trademark Office*